United States Patent [19]

Bolt, Jr. et al.

[11] Patent Number: 4,547,776

[45] Date of Patent: Oct. 15, 1985

[54] LOOP ANTENNA WITH IMPROVED BALANCED FEED

[75] Inventors: Conway A. Bolt, Jr., Pasadena; John W. Cassen, Glen Burnie; Helmut E. Schrank, Cockeysville, all of Md.

[73] Assignee: The United States of America as represented by the Secretary of the Navy, Washington, D.C.

[21] Appl. No.: 548,468

[22] Filed: Nov. 3, 1983

[51] Int. Cl.[4] ..... H01Q 11/14

[52] U.S. Cl. ..... 343/741; 343/744

[58] Field of Search ..... 343/741–744, 343/748, 829, 846, 866–868, 850

[56] References Cited

U.S. PATENT DOCUMENTS

| | | | |
|---|---|---|---|
| 2,368,618 | 2/1945 | Sandretto et al. | 343/743 |
| 2,749,544 | 6/1956 | Pike | 343/742 |
| 3,973,263 | 4/1973 | Green | 343/744 |
| 4,170,012 | 6/1978 | Kaloi | 343/700 MS |

FOREIGN PATENT DOCUMENTS

| | | | |
|---|---|---|---|
| 865478 | 2/1953 | Fed. Rep. of Germany | 343/743 |

*Primary Examiner*—Eli Lieberman
*Assistant Examiner*—Michael C. Wimer
*Attorney, Agent, or Firm*—R. F. Beers; H. A. David

[57] ABSTRACT

Loop radiating elements for microwave frequencies which result in balanced power division at the feed points and equi-phase currents in the radiating segments are in the form of an Alford loop design having a "kink" in the stripline path on the side of a printed circuit board opposite the cross-over to restore equal path lengths on both sides of a central feed terminal. Alternatively, the radiating segments of a loop may be in the form of end-loaded bent dipoles which are dual-fed on diametrically opposite points of the loop with equi-phase and amplitude signal. The result is loop radiating elements which have an axial null with a symmetrical doughnut radiating pattern.

1 Claim, 6 Drawing Figures

LOOP ANTENNA WITH IMPROVED BALANCED FEED

BACKGROUND OF THE INVENTION

1. Field of the Invention

The present invention relates to loop radiating elements, and more particularly to loop radiating elements operating at microwave frequencies above a reflecting ground plane parallel to the plane of the loop.

2. Description of the Prior Art

Surveillance radars operating from orbiting satellite platforms generally do not cover targets near the nadir direction because of excessive ground clutter, but do cover an annular region from the so-called "nadir hole" to the horizon. For some surveillance modes horizontal polarization is greatly preferred over vertical polarization, and for this case an array of horizontal loops is an attractive alternative to switched orthogonal dipoles. The element pattern of a loop is doughnut-shaped with nulls along the loop axis.

Most loop antennas are for low frequency communication or navigation system applications. An Alford loop, as shown in FIG. 1, is a square configuration fed by a two-wire balanced line connected to a pair of terminals at its center. This loop has a convenient input impedance (approximately 80 ohms) and uses a transposition (cross-over) connection on one side of the feed terminals to achieve the proper unidirectional currents in its four radiating segments.

An Alford loop designed for microwave frequencies in printed circuit form is shown in FIG. 2 where the cross-over is achieved by printing two parts of the loop on opposite sides of the circuit board. An inherent assymetry problem with this loop model at microwave frequencies is that the null is off-axis. This occurs because the cross-over on one side causes the path lengths from the center feed terminals on that side to be longer than those on the other side. The result is that the phases and amplitudes of the currents in the radiating segments of the loop are unbalanced (unequal), causing imperfect cancellation on-axis. Attempts to relocate the feed terminal off-center to compensate for the cross-over have caused impedance matching problems and have been generally unsuccessful.

SUMMARY OF THE INVENTION

Accordingly, the present invention provides radiating elements for microwave frequencies which result in balanced power division at the feed points and equi-phase currents in the radiating segments of the loops. The balance of an Alford loop design is accomplished by providing a "kink" in the stripline path on the side of a printed circuit board opposite the cross-over to restore equal path lengths on both sides of a central feed terminal, resulting in an axial null and the desired symmetrical doughnut pattern. Alternatively, either a square or circular configuration, dual-fed loop having two pairs of radiating segments in the form of end-loaded bent dipoles is fed with equi-phase and amplitude signals to produce the desired axial null and symmetrical doughnut pattern.

Therefore, it is an object of the present invention to provide loop radiating elements for microwave frequencies which have an axial null and a symmetrical doughnut radiation pattern.

Other objects, advantages and novel features will be apparent from the following detailed description when read in conjunction with the appended claims and attached drawing.

DESCRIPTION OF THE PREFERRED EMBODIMENT

Figure 1:
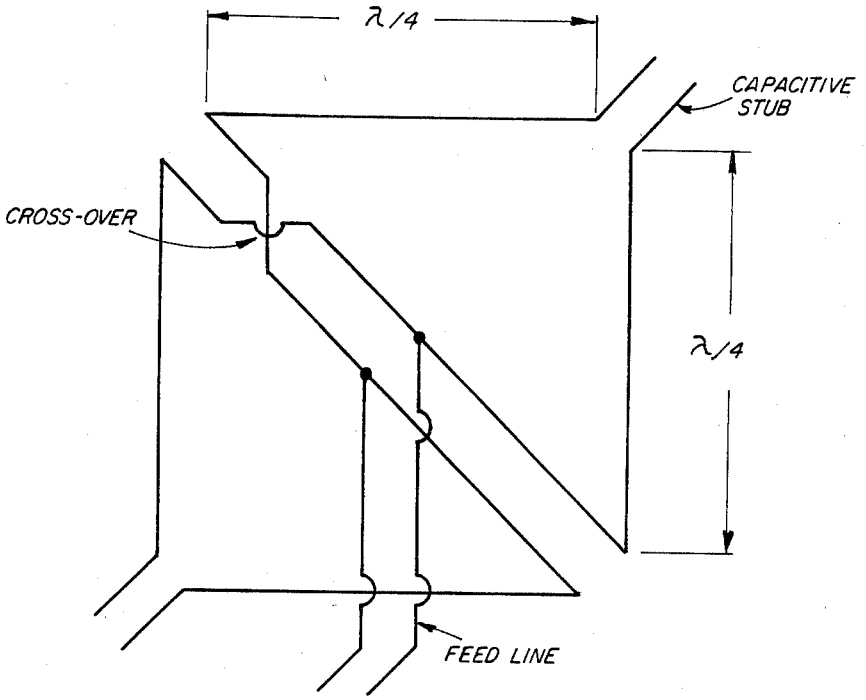
FIG. 1 (PRIOR ART)
FIG. 1 is a plan view of a prior art Alford Loop radiating element.
Figure 2:
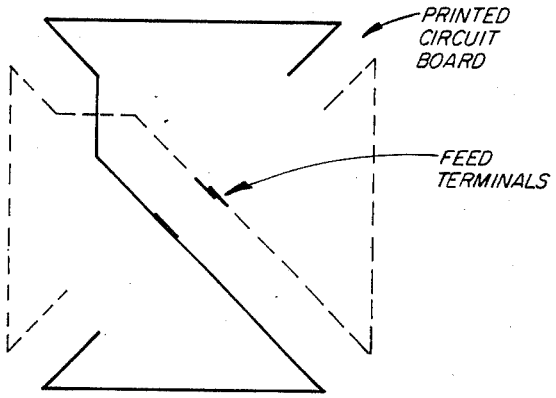
FIG. 2 (PRIOR ART)
FIG. 2. is a plan view of a prior art microwave stripline Alford loop radiating element.
Figure 3:
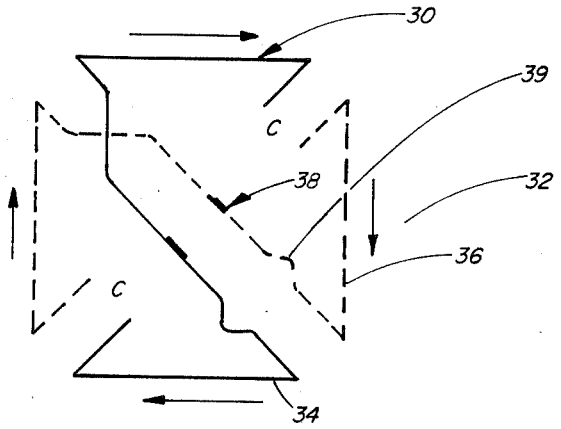
FIG. 3. is a plan view of an improved microwave stripline Alford loop radiating element according to the present invention.

Referring now to FIG. 3 an improved Alford loop radiating element is shown. An Alford loop 30 in stripline form is shown on a printed circuit board 32 or the like. One half 34 of the Alford loop 30 is on the top of the printed circuit board 32 and the other half 36 is on the bottom side of the PC board. The length of each radiating segment of the Alford loop is approximately one-quarter wavelength. A pair of feed terminals 38 is on the top side of the PC board 32 connected to the two halves 34,36 of the Alford loop. A "kink" 39 is included in the bottom half 36 of the Alford loop 30 to maintain equi-phase current characteristics. Capacitive stubs C also are included in the Alford loop 30 to fine tune the resonance of the loop.

Figure 4:
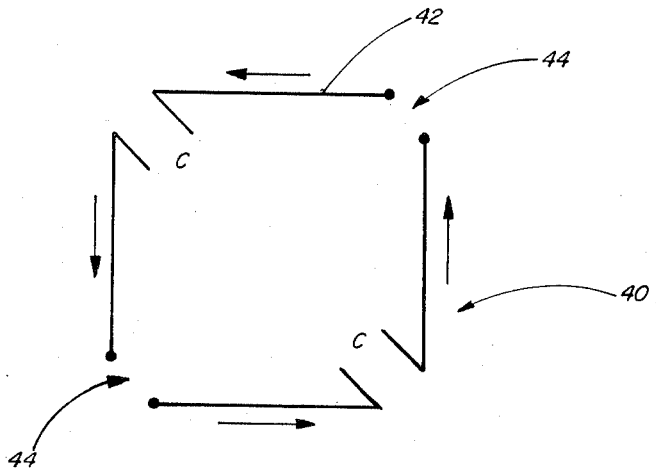
FIG. 4. is a plan view of a square configuration, dual fed loop radiating element according to the present invention.
Figure 5:
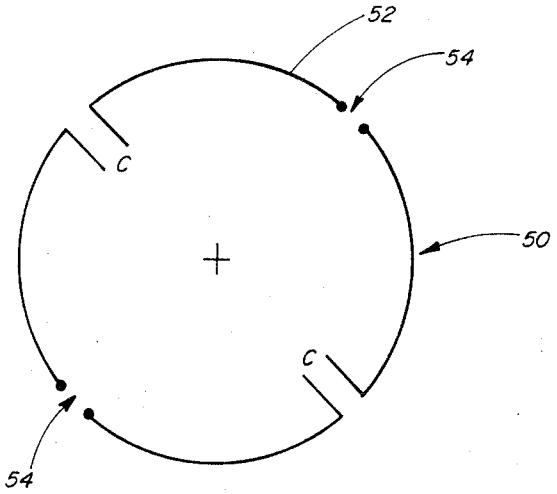
FIG. 5 is an alternate circular configuration form of the dual fed loop radiating element of FIG. 4.

Alternatively, a balanced loop radiating element may avoid the cross-over problem of the Alford loop by using a dual-fed element as shown in FIGS. 4 and 5. The dual fed element 40,50 is made up of segments 42,52 which define the symmetrical perimeter of a square (FIG. 4) or a circle (FIG. 5). Each element 40,50 has capacitive stubs C, and each has opposing feed terminals 44,54 which produce currents as shown by the arrows in FIG. 4. These elements 40,50 produce the same radiation pattern as that of the Alford loop 30 of FIG. 3, but eliminate the cross-over at the expense of being dual-fed. The length of each segment 42,52 of the elements 40,50 is less than one-quarter wavelength at the design frequency, and resonance is adjusted by the lengths of the capacitive loadings C. The two pairs of radiating segments 42,52 can be thought of as end-loaded bent dipoles.

For printed circuit board versions of the dual-fed loops each configuration is mounted above a ground plane and fed at the two feed terminals 44,54 by means of conventional split coaxial baluns. A tapered stripline balun ("infinite" balun), commonly used in spiral antennas and as used for the Alford loop 30 of FIG. 3, may also be used.

Figure 6:
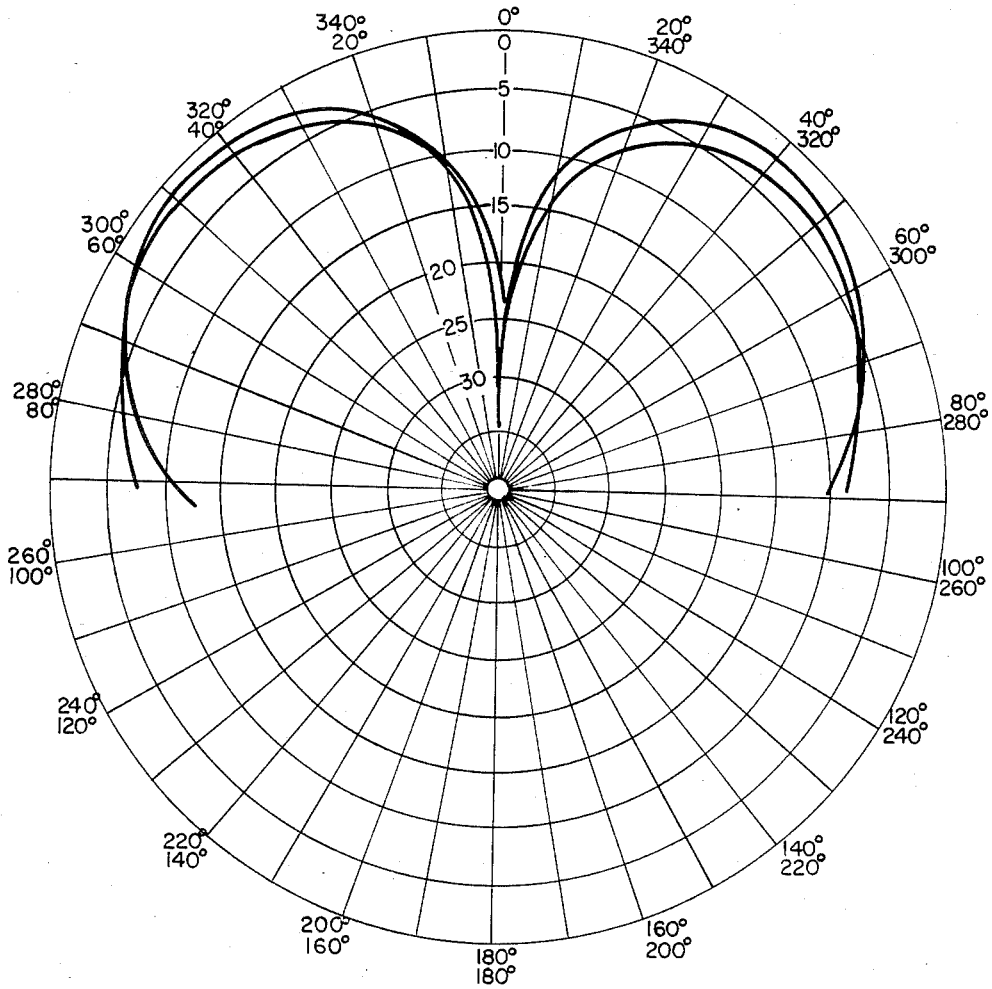
FIG. 6 is a polar chart of the radiation pattern for the loop radiating element of FIG. 5.

FIG. 6 is a representative radiation pattern for the circular loop 50 of FIG. 5. Two orthogonal principal plane cuts through the doughnut pattern are shown. Good axial nulls and symmetrical patterns appear in both planes. Limited control of the null widths can be achieved by varying the loop-to-ground plane spacing.

Thus, the present invention provides three loop radiators which provide symmetrical doughnut patterns with axial nulls and invariant (horizontal) polarization in all directions. These radiating loops may be used as radiators in large aperture phased arrays at microwave frequencies for radar, communication and/or navigation systems.

What is claimed is:

1. An improved Alford loop radiating element of the type having four radiating segments in a square configuration, a pair of center fed terminals, and a cross-over connection on one side of the feed terminals with two parts of the loop being on opposite sides of a printed circuit board, the improvement comprising a kink in the loop path on the side of said printed circuit board opposite said cross-over connection to add a path length equal to that of the crossed paths such that there is a balanced power division at said feed terminals and equiphase currents in said radiating segments.

* * * * *